United States Patent [19]

Saarinen

[11] Patent Number: 5,031,901

[45] Date of Patent: Jul. 16, 1991

[54] FLYWHEEL BRAKE MECHANISM FOR AN EXERCISE DEVICE

[75] Inventor: Sulevi Saarinen, Ilmarinen, Finland

[73] Assignee: Tunturipyora Oy, Turku, Finland

[21] Appl. No.: 475,874

[22] Filed: Feb. 6, 1990

[30] Foreign Application Priority Data

Feb. 21, 1989 [FI] Finland ..... 890828

[51] Int. Cl.[5] ..... A63B 22/06

[52] U.S. Cl. ..... 272/73; 310/78; 310/191

[58] Field of Search ..... 272/70, 72, 73, 129, 272/132; 310/77, 78, 105, 154, 191

[56] References Cited

U.S. PATENT DOCUMENTS

| | | | |
|---|---|---|---|
| 4,470,597 | 9/1984 | McFee | 272/70 X |
| 4,641,080 | 2/1987 | Gilennon et al. | 310/191 X |
| 4,688,790 | 8/1987 | Hokajärui | 272/73 |
| 4,752,066 | 6/1988 | Housayama | 272/73 |
| 4,822,032 | 4/1989 | Whitmore et al. | 272/72 X |
| 4,826,150 | 5/1989 | Minoura | 310/105 X |
| 4,938,474 | 6/1990 | Sweeney et al. | 272/70 |

FOREIGN PATENT DOCUMENTS

| | | | |
|---|---|---|---|
| 215177 | 3/1987 | European Pat. Off. | 272/73 |

*Primary Examiner*—Robert Bahr

*Attorney, Agent, or Firm*—Lyon & Lyon

[57] ABSTRACT

An exercise device is described in which a flywheel fitted in a frame structure and rotated by a rider is provided with a brake mechanism for selectively braking the rotation of the flywheel, as desired. The brake mechanism comprises a copper strap fitted on the periphery of the flywheel and permanent magnet pieces attached to an arch pivotably mounted to the frame structure. The position of the arch is adjustable so that the distance of the magnet pieces from the copper strap varies in a predetermined manner to achieve a desired braking effect. To achieve a simple and clear display a two-arm lever is pivotably attached to the frame structure, the shorter arm of which being arranged to make contact with the arch and to follow the movements thereof. The end of the longer arm of the lever is arranged such that, when moved in response to movement of the shorter arm, acts as a basis for a display indicating the braking effect of the flywheel.

5 Claims, 2 Drawing Sheets

FIG. 3
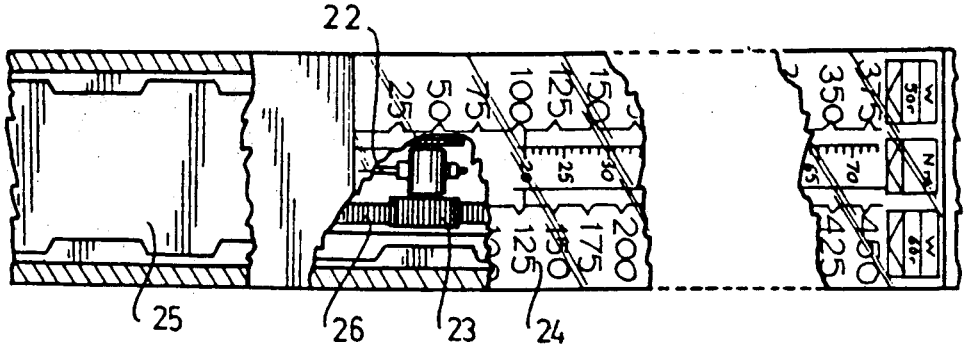
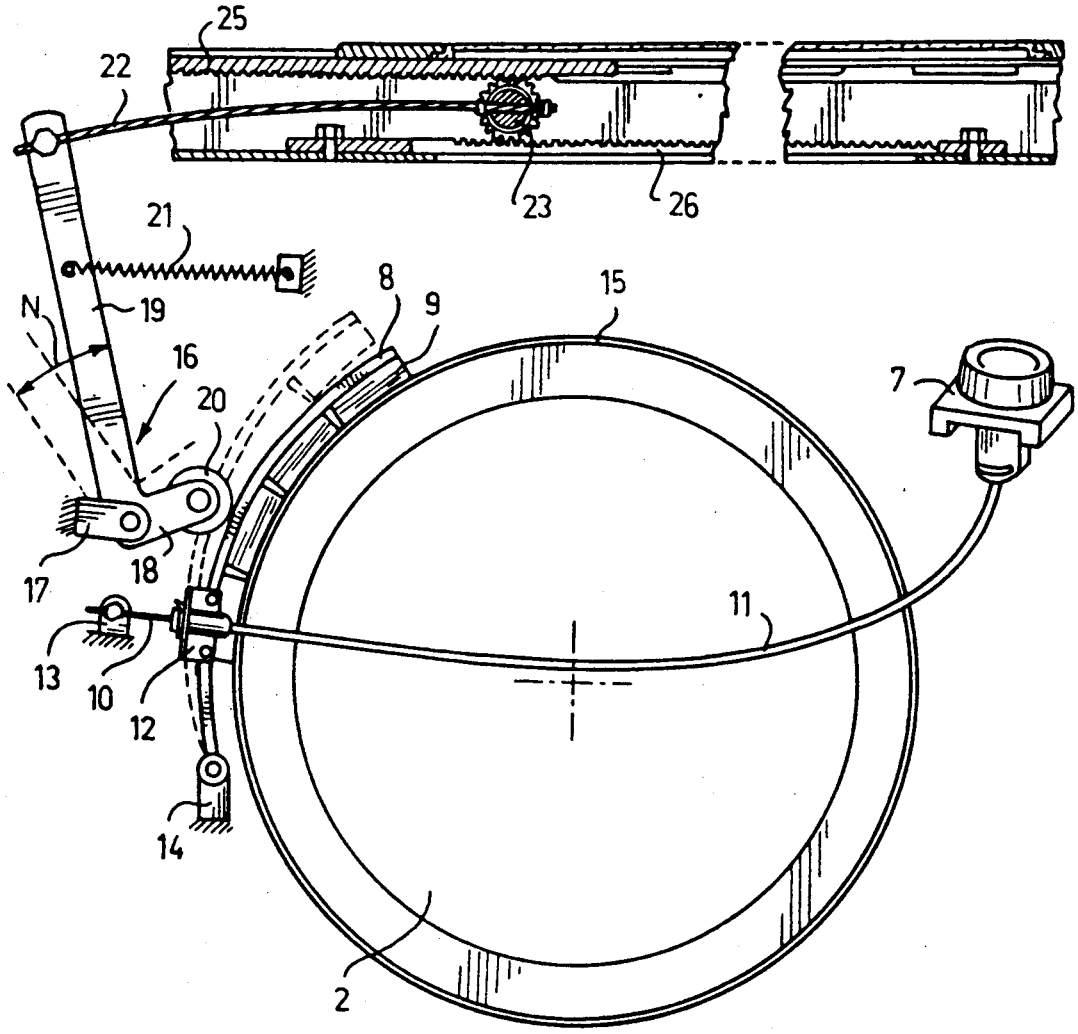
FIG. 2

FLYWHEEL BRAKE MECHANISM FOR AN EXERCISE DEVICE

The invention relates to an exercise device comprising a flywheel fitted in a frame structure; means for rotating the flywheel; and a brake mechanism for braking the rotation of the flywheel in a desired manner, the brake mechanism comprising a copper strap fitted on the periphery of the flywheel; permanent magnet pieces attached to an arch mounted turnably in the frame structure; and means for adjusting the position of the arch so that the distance of the permanent magnet pieces from the copper strap varies in a predetermined manner to achieve a desired braking effect.

This kind of exercise device is today well-known both in professional and domestic use. In place of a friction brake it has been suggested to use a magnetic brake in exercise devices. An advantage of a magnetic brake is that it is completely silent because no mechanical friction occurs. For this reason, a magnetic brake has a long service life.

A magnetic brake operates in such a way that the closer to the flywheel the magnets are positioned, the more they brake the rotation of the flywheel. The braking torque and/or the braking effect, in cases where the rate of rotation is known, is dependent on the position of the magnets relative to the flywheel. On the basis of this data, it is, in principle, possible to provide a display in which the data is visible.

A drawback of prior art devices, however, is that their displays do not operate properly. This is because the range of movement of the magnets is very small, which makes the display unclear and, as a consequence, impractical.

The object of the invention is to provide an exercise device by means of which the drawbacks of the prior art can be eliminated. This is achieved by means of a device according to the invention which is characterized in that a two-arm lever is pivotably attached to the frame structure, the shorter arm of the lever being arranged to make contact with the arch and to follow the movements of the arch, and the movement of the end of the longer arm of the lever being arranged to act as a basis for a display indicating the braking effect of the flywheel.

An advantage of the invention is that all the benefits of the magnetic brake can be achieved and the scale of the display device can be made sufficiently large, easy to read, and accurate. The display device can be such that it complies with the existing DIN norms, for instance. Another advantage of the invention is that its lever mechanism is simple. For this reason the device of the invention is advantageous in manufacturing costs, reliable in operation, silent, and does not need maintenance. Still another advantage is that the display itself, that is, the meter indicating the torque and/or the effect can be formed by existing components.

In the following a preferred embodiment of the invention will be described as illustrated in in the attached drawing, wherein FIG. 1 is a general side view of an exercise device of the invention;

FIG. 2 is a general side view of the brake mechanism and display device of the device of FIG. 1;

FIG. 3 is a top view of the display device of FIG. 2.

Figure 1:
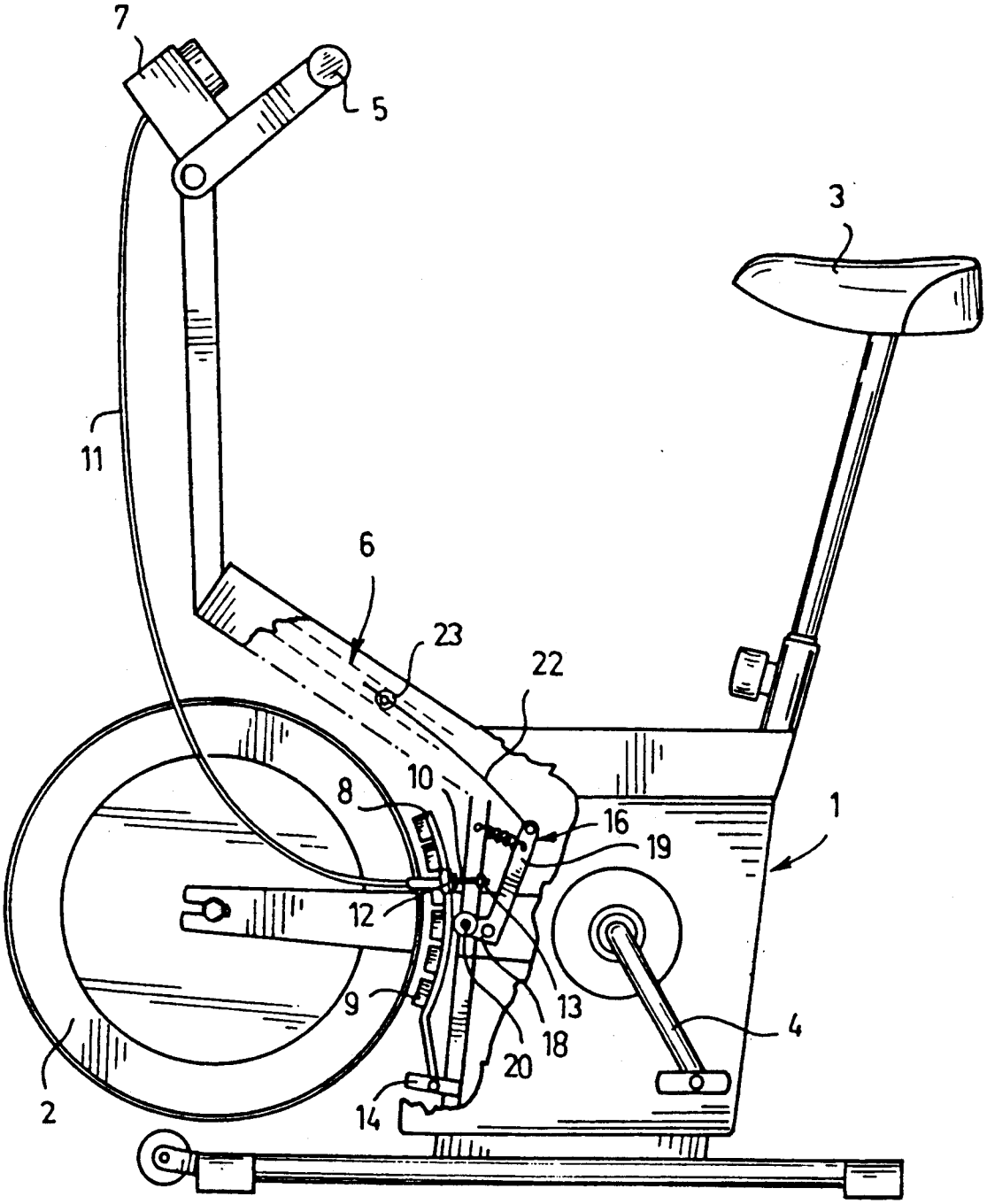

FIG. 1 shows generally the exercise device of the invention. The reference numeral 1 indicates generally a frame structure on which a flywheel 2 of cast iron, for instance, is fitted. The exercise device further comprises a seat 3, means 4 for rotating the flywheel 2, a hand support 5, a brake mechanism, and a display device 6.

FIG. 2 shows generally the braking mechanism used in the device of FIG. 1. For the sake of clarity, the means for the rotation of the flywheel, the frame structure, etc., are not shown in FIG. 2. These parts are quite obvious to one skilled in the art, so they will not be described many more detail herein.

In FIG. 2, the reference numeral 7 indicates a wire rope control device which effects a positively controlled pulling and pushing movement of an arch 8 to which permanent magnets 9 are attached. The cover of a wire rope 10 is indicated with the reference numeral 11. In place of a normal support spiral, the wire rope cover 11 preferably comprises longitudinally extending support wires which eliminate the resilience of the cover in the longitudinal direction. The reference numeral 12 indicates a fastener by means of which the lower end of the cover 11 is attached to the arch 8. The reference numeral 13 indicates a fastener by means of which the end of the wire rope 10 is attached to the frame of the exercise device. Due to this arrangement the cover 11 acts as a part which moves the arch 8. An advantage of this arrangement is that the direction of entry of the wire rope is advantageous in view of the operation, as appears from FIG. 1. The arch 8 is pivotably fastened to the frame of the exercise device by means of a member 14. The movement of the arch is indicated by broken lines in FIG. 2. In FIG. 2, a copper strap fitted on the periphery of the flywheel is indicated with the reference numeral 15. The eddy currents occurring in the copper strap 15 create a force braking the movement of the flywheel.

The reference numeral 16 indicates generally a two-arm lever. The lever 16 is pivotably fastened to the frame of the exercise device by means of a fastener 17. The lever 16 comprises a shorter arm 18 and a longer arm 19. In the example of the figure, a roller 20 is mounted in bearings at the end of the shorter arm 18, and the longer arm is provided with a spring member 21 having one end attached to the frame, whereby the spring member 21 keeps the roller in constant contact with the arch 8. During the movement of the arch 8 the lever 16 turns as shown by the arrow N.

The reference numeral 22 indicates a wire rope one end of which is attached to the longer arm of the lever 16 while the other end is attached to multiplying gear wheels 23 in the display device. FIG. 3 is a top view of the display device. The scale of the display device is indicated with the reference numeral 24, the indicator slide with the reference numeral 25 and the cogging of the scale housing with the reference numeral 26. The display device shown in FIGS. 2 and 3 is known per se from Finnish Patent Specification 71428, for instance. The operation of the display device is quite obvious to one skilled in the art. The scale 24 may indicate, e.g., torque, braking effect applied, or both as in the example of the figure.

In principle, the arrangement of FIGS. 2 and 3 operates in the following way. When using the exercise device, the flywheel 2 rotates at a speed depending on the user and the braking. The braking effect depends on the distance of the magnets 9 from the surface of the strap 15. There always exists a distance between the magnets 9 and the strap, that is, the magnets 9 never make contact with the strap 15. Eddy currents are created in the strap by the magnets, and the eddy currents cause a braking effect. The braking effect is the smaller the greater the distance of the magnets from the strap. Assume that the situation is such as shown in FIG. 2. If the braking effect is to be decreased, the knob of the control device 7 is turned, so that the cover 11 pushes the arch to a position shown by broken lines in FIG. 2. The lever 16 thereby pivots as shown by the arrow N, to a position similarly shown by broken lines. As appears from FIG. 2, the shorter arm 18 of the lever 16 follows the small movement of the arch, so that this small movement is converted into the larger movement of the longer arm.

The large movement of the end of the arm 19 is transmitted through the wire rope 22 to the display device. In the example of the figures, the movement of the end of the arm 19 is once more enlarged by means of the gear wheels. The braking torque and effect are to be read directly from the scale 24.

When the braking effect is to be increased, the knob of the control device 7 is turned in the opposite direction, whereby the cover 11 pulls the arch 8 so that the magnet pieces are displaced closer to the strap 15. The spring member 21 thereby pivotably biases the lever 16 so that the roller 20 remains in constant contact with the arch 8. When the lever 16 pivots, the movement is transmitted through the wire rope 22 to the display device.

The above example is by no means intended to restrict the invention, as the invention can be modified completely freely within the scope of the claims. Accordingly, it is obvious that the invention or its parts need not necessarily be exactly similar to those shown in the figures but other solutions are possible as well. The support and control between the shorter arm 18 of the lever 16 and the arch can be realized in some other way than that shown in the figures. The end of the arm 18 can be attached to the arch 8 in such a manner that the arch displaces the lever in both directions. Thereby the spring member can be omitted. The operation of the control wire rope may also be reverse to that shown in the figures, that is, the cover can be attached to the frame and the wire rope to the arch. The display device need not, either, be such as disclosed in Finnish Patent 71428 and shown in the figures, but other solutions can be used as well. It is even possible that the longer arm 19 of the lever 16, as such, acts as an indicator. The movement of the end of the arm 19 can be transmitted to the display device by any suitable means, that is, the wire rope 22 can be replaced with any suitable member. The display device can also be electronic, whereby the movement of the end of the arm 19 of the lever 16 can be followed by electrical means.

I claim:

1. An exercise device comprising a flywheel fitted in a frame structure; means for rotating the flywheel; and a brake mechanism for selectively braking the rotation of the flywheel, the brake mechanism comprising a copper strap fitted on the periphery of the flywheel; permanent magnet pieces attached to an arch pivotably mounted in the frame structure; and means for adjusting the position of the arch so that the distance of the permanent magnet pieces from the copper strap varies in a predetermined manner to achieve a desired braking effect, said exercise device further comprising a two-arm lever which is pivotably attached to the frame structure, the shorter arm of the lever being arranged to make contact with the arch and to follow the movements of the arch, and the movement of the end of the longer arm of the lever being arranged to actuate a display indicating the braking effect of the flywheel.

2. An exercise device according to claim 1, wherein a roller is mounted in bearings in the shorter arm of the lever, and the longer arm of the lever is provided with a spring member arranged to keep the roller in contact with the arch.

3. An exercise device according to claim 1, wherein the shorter arm of the lever is operatively connected to the arch.

4. An exercise device according to any of the preceding claims, wherein the end of the longer arm of the lever is provided with a means transmitting the movement of said end to a display meter.

5. An exercise device according to any of the preceding claims 1 to 3, wherein the longer arm of the lever is an indicator.

* * * * *